US007837853B2

(12) United States Patent
Ansell et al.

(10) Patent No.: US 7,837,853 B2
(45) Date of Patent: Nov. 23, 2010

(54) PROCESS TO BLEND A MINERAL AND A FISCHER-TROPSCH DERIVED PRODUCT ONBOARD A MARINE VESSEL

(75) Inventors: Claire Ansell, Chester (GB); Richard Hugh Clark, Chester (GB); Richard John Heins, Chester (GB)

(73) Assignee: Shell Oil Company, Houston, TX (US)

( * ) Notice: Subject to any disclaimer, the term of this patent is extended or adjusted under 35 U.S.C. 154(b) by 491 days.

(21) Appl. No.: 11/918,118

(22) PCT Filed: Apr. 11, 2006

(86) PCT No.: PCT/EP2006/061513

§ 371 (c)(1),
(2), (4) Date: Oct. 9, 2007

(87) PCT Pub. No.: WO2006/108839

PCT Pub. Date: Oct. 19, 2006

(65) Prior Publication Data

US 2009/0093658 A1 Apr. 9, 2009

(30) Foreign Application Priority Data

Apr. 11, 2005 (EP) ..... 05252255

(51) Int. Cl.
*C10L 1/04* (2006.01)
*C10M 101/02* (2006.01)

(52) U.S. Cl. ..... 208/15; 208/19; 208/950; 518/700; 518/728; 114/74 R

(58) Field of Classification Search ..... 208/15, 208/19, 950; 114/74 R
See application file for complete search history.

(56) References Cited

U.S. PATENT DOCUMENTS

| | | | | |
|---|---|---|---|---|
| 4,943,672 | A | 7/1990 | Hamner et al. | 585/737 |
| 5,059,299 | A | 10/1991 | Cody et al. | 208/27 |
| 5,689,031 | A | 11/1997 | Berlowitz et al. | 585/734 |
| 6,204,426 | B1 | 3/2001 | Miller et al. | 585/739 |
| 6,296,757 | B1 | 10/2001 | Wittenbrink et al. | 208/15 |
| 6,309,432 | B1 | 10/2001 | Wittenbrink et al. | 44/436 |
| 6,420,618 | B1 | 7/2002 | Berlowitz et al. | 585/310 |
| 6,518,321 | B1 | 2/2003 | O'Rear et al. | 518/700 |
| 6,541,524 | B2 * | 4/2003 | O'Rear et al. | 518/700 |
| 6,806,237 | B2 * | 10/2004 | O'Rear | 508/110 |
| 7,488,411 | B2 * | 2/2009 | Dieckmann et al. | 208/21 |
| 2002/0128332 | A1 | 9/2002 | O'Rear et al. | 518/728 |
| 2003/0100453 | A1 * | 5/2003 | O'Rear | 508/110 |
| 2006/0065573 | A1 * | 3/2006 | Dieckmann et al. | 208/21 |
| 2006/0069295 | A1 * | 3/2006 | Dieckmann et al. | 585/3 |
| 2006/0069296 | A1 * | 3/2006 | Dieckmann et al. | 585/9 |
| 2006/0243184 | A1 * | 11/2006 | O'Rear | 114/121 |

FOREIGN PATENT DOCUMENTS

| | | |
|---|---|---|
| EP | 583836 | 2/1994 |
| EP | 668342 | 8/1995 |
| EP | 668342 | 8/1999 |
| EP | 1101813 | 5/2001 |
| EP | 776959 | 10/2004 |
| WO | WO9714768 | 4/1997 |
| WO | WO9714769 | 4/1997 |
| WO | WO9920720 | 4/1999 |
| WO | WO9934917 | 7/1999 |
| WO | WO0011116 | 3/2000 |
| WO | WO0011117 | 3/2000 |
| WO | WO0020534 | 4/2000 |
| WO | WO0020535 | 4/2000 |
| WO | WO0183406 | 11/2001 |
| WO | WO0183641 | 11/2001 |
| WO | WO0183647 | 11/2001 |
| WO | WO0183648 | 11/2001 |
| WO | WO02064710 | 8/2002 |
| WO | WO02070627 | 9/2002 |
| WO | WO02070629 | 9/2002 |
| WO | WO02070630 | 9/2002 |
| WO | WO02070631 | 9/2002 |
| WO | WO03070857 | 8/2003 |
| WO | WO2003087273 | 10/2003 |
| WO | WO2004035713 | 4/2004 |
| WO | WO2004104142 | 12/2004 |

* cited by examiner

*Primary Examiner*—Ellen M McAvoy

(57) ABSTRACT

Process to blend a mineral derived hydrocarbon product and a Fischer-Tropsch derived hydrocarbon product by providing in a storage vessel of a marine vessel a quantity of mineral derived hydrocarbon product and Fischer-Tropsch derived hydrocarbon product such that initially the mineral derived hydrocarbon product is located substantially above the Fischer-Tropsch derived hydrocarbon product, transporting the combined products in the marine vessel from one location to another location, also referred to as the destination, and obtaining a blended product at arrival of the marine vessel at its destination.

12 Claims, No Drawings

PROCESS TO BLEND A MINERAL AND A FISCHER-TROPSCH DERIVED PRODUCT ONBOARD A MARINE VESSEL

PRIORITY CLAIM

The present application claims priority to European Patent Application 05252255.4 filed 11 Apr. 2005.

FIELD OF THE INVENTION

The invention relates to a process to blend a mineral derived hydrocarbon product and a Fischer-Tropsch derived hydrocarbon product.

BACKGROUND OF THE INVENTION

WO-A-2004104142 discloses the blending of a mineral derived hydrocarbon product and a Fischer-Tropsch derived hydrocarbon product and subsequent supplying of the blend to a ship.

A process to blend mineral derived gas oil and a Fischer-Tropsch derived gas oil is described WO-A-03087273. This publication describes that a mineral derived may be blended in a refinery environment to achieve a blended product having a certain cetane number.

Although WO-A-03087273 provides a process to achieve a blend having a certain quality property it can still be improved in terms of the blending operation itself. The present process provides such a solution.

SUMMARY OF THE INVENTION

Process to blend a mineral derived hydrocarbon product and a Fischer-Tropsch derived hydrocarbon product by providing in a storage vessel of a marine vessel a quantity of mineral derived hydrocarbon product and Fischer-Tropsch derived hydrocarbon product such that initially the mineral derived hydrocarbon product is located substantially above the Fischer-Tropsch derived hydrocarbon product, transporting the combined products in the marine vessel from one location to another location, also referred to as the destination, and obtaining a blended product at arrival of the marine vessel at its destination.

Applicants found that a fully blended product can be obtained by the process according to the invention. The process makes available a blended product suited for direct use near the customer or at a refinery for further upgrading. The process eliminates blending operations at the destination and eliminates the use of multiple marine vessels to carry the separate blending products to the destination.

DETAILED DESCRIPTION OF THE INVENTION

The invention is directed to a process to blend a mineral derived hydrocarbon product and a Fischer-Tropsch derived hydrocarbon product. The Fischer-Tropsch derived hydrocarbon product is suitably obtained by converting a mixture of carbon monoxide and hydrogen in the presence of a suitable Fischer-Tropsch catalyst under Fischer-Tropsch operating conditions. The catalysts used for the catalytic conversion of the mixture comprising hydrogen and carbon monoxide into the Fischer-Tropsch derived paraffinic hydrocarbon product are known in the art. Catalysts for use in this process frequently comprise, as the catalytically active component, a metal from Group VIII of the Periodic Table of Elements.

Particular catalytically active metals include ruthenium, iron, cobalt and nickel. Cobalt is a preferred catalytically active metal.

Examples of suitable Fischer-Tropsch synthesis processes are for example the so-called commercial Sasol process, the Shell Middle Distillate Synthesis Process or the AGC-21 ExxonMobil process. These and other processes are for example described in more detail in EP-A-776959, EP-A-668342, U.S. Pat. No. 4,943,672, U.S. Pat. No. 5,059,299, WO-A-9934917 and WO-A-9920720 and are incorporated by reference. The Fischer-Tropsch process may be carried out in a slurry reactor, a fixed bed reactor, especially a multitubular fixed bed reactor or in a three phase fluidised bed reactor.

Syngas, i.e. the mixture of carbon monoxide and hydrogen used in the Fischer-Tropsch process may be prepared from various hydrocarboneous sources such as for example biomass, coal, mineral crude oil fractions like residual fractions and methane containing gases, for example natural gas or coal bed methane gas.

The Fischer-Tropsch derived hydrocarbon product is suitably liquid at 0° C. If the product is not liquid it is preferably kept in the storage vessel of the ship at conditions at which the product is liquid. The Fischer-Tropsch derived product can be the wax such as is directly prepared in the Fischer-Tropsch synthesis step. Suitably this Fischer-Tropsch synthesis product is first subjected to a mild hydroisomerisation to reduce the congealing point of the product and increase its pumpability and to more easily have the product in the liquid state in the process of the present invention. Such a product is also referred to as Syncrude.

The Fischer-Tropsch derived hydrocarbon product may also be the lower boiling liquid fractions as isolated from the waxy Fischer-Tropsch product boiling between 35 and 300° C. These products comprising substantially, i.e. more than 80 wt % of, normal paraffins, may be shipped as hydrocarbon solvents, as steam cracker feedstock or as feedstock for the preparation of detergents.

Alternatively the waxy product is subjected to a hydrocracking/hydroisomerisation process wherein lower boiling fractions are obtained, such as for example paraffin products boiling in the naphtha, kerosene and gas oil boiling range. The partly isomerised liquid products so obtained may be shipped to end customers for use as aviation fuel, diesel fuel, industrial gas oil, drilling fluids, steam cracker feedstock or solvents. The partly isomerised wax, also referred to as waxy Raffinate, as obtained in such process steps may advantageously be further processed by means of solvent or catalytic dewaxing to obtain lubricating base oils or may be shipped as such to be used as an intermediate product to base oil manufacturing locations more near to the end users. Waxy Raffinate is a distillate fraction. Residual fractions boiling in the base oil range may also be used. However it may be more difficult to keep these products in a liquid state during blending. Examples of such processes are described in more detail in U.S. Pat. No. 6,309,432, U.S. Pat. No. 6,296,757, U.S. Pat. No. 5,689,031, EP-A-668342, EP-A-583836, U.S. Pat. No. 6,420,618, WO-A-02070631, WO-A-02070629, WO-A-02070627, WO-A-02064710 and WO-A-02070630, which references are incorporated by reference. The referred to hydrocracking/hydroisomerisation and optimal dewaxing steps are thus performed at the Fischer-Tropsch manufacturing location and the resulting above described liquid products are suited as the Fischer-Tropsch hydrocarbon products to be shipped.

The volume ratio between the mineral derived hydrocarbon product and the Fischer-Tropsch derived product may range in a wide span, for example between 1:99 and 99:1 and more preferably between 10:90 and 90:10. The mineral derived hydrocarbon product preferably has a T90 vol % boiling point as measured by ASTM D86, which is greater than the T50 vol % boiling point of the Fischer-Tropsch derived hydrocarbon product. More preferably more than 50 vol % and even more preferably more than 80 vol % of the boiling ranges of the mineral and the Fischer-Tropsch derived products overlap.

The mineral hydrocarbon product may be any product which is extracted from a subterranean environment or derivatives therefrom. Examples of such products are crude mineral oil, gas field condensates, plant condensates, naphtha, kerosene, gas oil, vacuum distillates, deasphalted oils, residual fractions of crude oils and the like.

Examples of combinations for which the present process will find utility are the blending of mineral crude oil and syncrude, blending of Fischer-Tropsch derived naphtha and gas field condensate, blending of Fischer-Tropsch derived gas oil and mineral derived gas oil and the blending of Fischer-Tropsch derived waxy raffinate and mineral oil derived vacuum distillates and/or mineral oil derived deasphalted oil.

Preferably the Fischer-Tropsch derived hydrocarbon product is the gas oil fraction, preferably as obtained after hydroisomerisation. The gas oil product may thus be obtained by fractionation of such a Fischer-Tropsch synthesis product or obtained from a hydroconverted (hydrocracking/hydroisomerisation) Fischer-Tropsch synthesis product. Optionally the gas oil may have been subjected to a catalytic dewaxing treatment. Mixtures of the aforementioned gas oil fractions may also be used as the Fischer-Tropsch derived hydrocarbon product. Examples of Fischer-Tropsch derived gas oils are described in EP-A-583836, WO-A-9714768, WO-A-9714769, WO-A-0011116, WO-A-0011117, WO-A-0183406, WO-A-0183648, WO-A-0183647, WO-A-0183641, WO-A-0020535, WO-A-0020534, EP-A-1101813, WO-A-03070857 and U.S. Pat. No. 6,204,426.

Suitably the Fischer-Tropsch derived gas oil will consist of at least 90 wt %, more preferably at least 95 wt % of iso and linear paraffins. The weight ratio of iso-paraffins to normal paraffins will suitably be greater than 0.3. This ratio may be up to 12. Suitably this ratio is between 2 and 6. The actual value for this ratio will be determined, in part, by the hydroconversion process used to prepare the Fischer-Tropsch derived gas oil from the Fischer-Tropsch synthesis product. Some cyclic-paraffins may be present. By virtue of the Fischer-Tropsch process, the Fischer-Tropsch derived gas oil has essentially zero content of sulphur and nitrogen (or amounts which are no longer detectable). These hereto-atom compounds are poisons for Fischer-Tropsch catalysts and are removed from the synthesis gas that is the feed for the Fischer-Tropsch process. Further, the process does not make aromatics, or as usually operated, virtually no aromatics are produced. The content of aromatics as determined by ASTM D 4629 will typically be below 1 wt %, preferably below 0.5 wt % and most preferably below 0.1 wt %.

The Fischer-Tropsch derived gas oil will suitably have a distillation curve which will for its majority be within the typical gas oil range: between about 150 and 400° C. The Fischer-Tropsch gas oil will suitably have a T90 wt % of between 320-400° C., a density of between about 0.76 and 0.79 g/cm$^3$ at 15° C., a cetane number greater than 70, suitably between about 74 and 82, and a viscosity between about 1.9 and 4.5 centistokes at 40° C.

The above Fischer-Tropsch derived gas oil is preferably blended with a mineral derived kerosene or gas oil or mixtures of said kerosene and gas oil. Preferred mineral derived gas oils or kerosenes are gas oils or kerosenes as obtained from refining and optionally (hydro)processing of a crude mineral source or the gas oil or kerosene fraction as isolated from a gas field condensate. The mineral derived gas oil may be a single gas oil stream as obtained in such a refinery process or be a blend of several gas oil fractions obtained in the refinery process via different processing routes. Examples of such different gas oil fractions as produced in a refinery are straight run gas oil, vacuum gas oil, gas oil as obtained in a thermal cracking process and light and heavy cycle oil as obtained in a fluid catalytic cracking unit and gas oil as obtained from a hydrocracker unit or the equivalent kerosene fraction.

The straight run gas oil or kerosene fraction is the fraction which has been obtained in the atmospheric distillation of the crude mineral refinery feedstock. The above fractions suitably have an Initial Boiling Point (IBP) of between 150 and 280° C. and a Final Boiling Point (FBP) of between 290 and 380° C. The vacuum gas oil is the gas oil fraction as obtained in the vacuum distillation of the residue as obtained in the above referred to atmospheric distillation of the crude mineral refinery feedstock. The vacuum gas oil has an IBP of between 240 and 300° C. and a FBP of between 340 and 380° C. The thermal cracking process also produces a gas oil fraction. This gas oil fraction has an IBP of between 180 and 280° C. and a FBP of between 320 and 380° C. The light cycle oil fraction as obtained in a fluid catalytic cracking process will have an IBP of between 180 and 260° C. and a FBP of between 320 and 380° C. The heavy cycle oil fraction as obtained in a fluid catalytic cracking process will have an IBP of between 240 and 280° C. and a FBP of between 340 and 380° C. These feedstocks may have a sulphur content of above 0.05 wt %. The maximum sulphur content will be about 2 wt %. Although the Fischer-Tropsch derived gas oil comprises almost no sulphur it could still be necessary to lower the sulphur level of the mineral derived gas oil in order to meet the current stringent low sulphur specifications. Typically the reduction of sulphur will be performed by processing these gas oil fractions in a hydrodesulphurisation (HDS) unit.

Gas oil as obtained in a fuels hydrocracker has suitably an IBP of between 150 and 280° C. and a FBP of between 320 and 380° C.

The cetane number of the blend of mineral derived gas oil as described above is preferably greater than 40 and less than 70. If also other properties like for example Cloud Point, CFPP (cold filter plugging point), Flash Point, Density, Di+-aromatics content, Poly Aromatics and/or distillation temperature for 95% recovery comply with the local regulations the blend may be advantageously used as a diesel fuel component.

Preferably the final blended gas oil product comprising the Fischer-Tropsch and the mineral derived gas oil will have a sulphur content of at most 2000 ppmw (parts per million by weight) sulphur, preferably no more than 500 ppmw, most preferably no more than 50 or even 10 ppmw. The density of such a blend is typically less than 0.86 g/cm$^3$ at 15° C., and preferably less than 0.845 g/cm$^3$ at 15° C. The lower density of such a blend as compared to conventional gas oil blends results from the relatively low density of the Fischer-Tropsch derived gas oils. The above fuel composition is suited as fuel in an indirect injection diesel engine or a direct injection diesel engine, for example of the rotary pump, in-line pump, unit pump, electronic unit injector or common rail type.

The final gas oil blend may be an additised (additive-containing) oil or an unadditised (additive-free) oil. If the fuel oil is an additised oil, it will contain minor amounts of one or more additives, e.g. one or more additives selected from detergent additives, for example those obtained from Infineum (e.g., F7661 and F7685) and Octel (e.g., OMA 4130D); lubricity enhancers, for example EC 832 and PARADYNE 655 (ex Infineum), HITEC E580 (ex Ethyl Corporation), VEKTRON 6010 (ex Infineum) (PARADYNE, HITEC and VEKTRON are trademarks) and amide based additives such as those available from the Lubrizol Chemical Company, for instance LZ 539 C; dehazers, e.g., alkoxylated phenol formaldehyde polymers such as those commercially available as NALCO EC5462A (formerly 7D07) (ex Nalco), and TOLAD 2683 (ex Petrolite) (NALCO and TOLAD are trademarks); anti-foaming agents (e.g., the polyether-modified polysiloxanes commercially available as TEGOPREN 5851 and Q 25907 (ex Dow Corning), SAG TP-325 (ex OSi), or RHODORSIL (ex Rhone Poulenc)) (TEGOPREN, SAG and RHODORSIL are trademarks); ignition improvers (cetane improvers) (e.g., 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g., that sold commercially by Rhein Chemie, Mannheim, Germany as "RC 4801", a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g., the pentaerythritol diester of polyisobutylene-substituted succinic acid); corrosion inhibitors; reodorants; anti-wear additives; anti-oxidants (e.g., phenolics such as 2,6-di-tert-butyl-phenol, or phenylenediamines such as N,N'-di-sac-butyl-p-phenylenediamine); and metal deactivators.

The additive concentration of each such additional component in the additivated fuel composition is preferably up to 1% w/w, more preferably in the range from 5 to 1000 ppmw, advantageously from 75 to 300 ppmw, such as from 95 to 150 ppmw.

In addition to the above gas oil components also a relatively small portion of an oxygenate type fuel component may be present in the final blend. to obtain diesel fuel as for example described in WO-A-2004035713. The oxygenate fuel may be present in a content of between 2 and 20 wt %; more preferably between 2 and 10 wt % as measured in the final fuel composition. The oxygenate is an oxygen containing compound, preferably containing only carbon, hydrogen and oxygen. It may suitably be a compound containing one or more hydroxyl groups —OH, and/or one or more carbonyl groups C═O, and/or one or more ether groups —O—, and/or one or more ester groups —C(O)O—. It preferably contains from 1 to 18 carbon atoms and in certain cases from 1 to 10 carbon atoms. Ideally it is biodegradable. It is suitably derived from organic material, as in the case of currently available "biofuels" such as vegetable oils and their derivatives.

Preferred oxygenates for use are esters, for example alkyl, preferably C1 to C8 or C1 to C5, such as methyl or ethyl, esters of carboxylic acids of vegetable oils. The carboxylic acid in this case may be an optionally substituted, straight or branched chain, mono-, di- or multi-functional C1 to C6 carboxylic acid, typical substituents including hydroxy, carbonyl, ether and ester groups. Suitable examples of oxygenates (iii) include succinates and levulinates.

Ethers are also usable as the oxygenate (iii), for example dialkyl (typically C1 to C6) ethers such as dibutyl ether and dimethyl ether.

Alternatively the oxygenate may be an alcohol, which may be primary, secondary or tertiary. It may in particular be an optionally substituted (though preferably unsubstituted) straight or branched chain C1 to C6 alcohol, suitable examples being methanol, ethanol, n-propanol and iso-propanol. Typical substituents include carbonyl, ether and ester groups. Methanol and in particular ethanol may for instance be used.

The oxygenate (iii) will typically be a liquid at ambient temperature, with a boiling point preferably from 100 to 360° C., more preferably from 250 to 290° C. Its density is suitably from 0.75 to 1.2 g/cm$^3$, more preferably from 0.75 to 0.9 g/cm$^3$ at 15° C. (ASTM D4502/IP 365), and its flash point greater than 55° C. Adding the additives and/or the oxygenates may be performed at the destination or on-board the marine vessel as part of the process of the present invention. Even more preferred is to add, or at least part of, the additives and/or the oxygenates when off-loading the blended product from the marine vessel at the destination. Addition is preferably performed by means of so-called in-line blending. This is advantageous because the blend as thus obtained can be directly used as a finished fuel for use as Automotive Gas Oil (AGO) or as an Industrial Gas Oil (IGO). Thus a separate blending operation in a blending park at the destination is avoided and a more efficient process is obtained.

The mineral derived hydrocarbon product can be loaded at the same location or at a different location from where the Fischer-Tropsch derived product is loaded to the storage vessel of the marine vessel. With substantially above is meant that at loading is meant that at least 50, preferably at least 70 and even more preferably at least 90 vol %, of the Fischer-Tropsch derived product is present in the lower half of the storage vessel. When loading the marine vessel using a bottom filling device the mineral hydrocarbon product is preferably supplied first and the Fischer-Tropsch derived product second. With a blended product at the destination is meant a mixture wherein the difference in density between a sample taken at 10% of the liquid height below the liquid surface, referred to as d10, and the density of a sample taken at 90% of the liquid height below the liquid surface, referred to as d90, is small, preferably such that the ratio (d90-d10)/d10 is less than 0.01, more preferably less than 0.001. Preferably the duration of the blending operation during transport to the destination is at least 10 days, more preferably at least 20 days. Preferably the marine vessel travels through the more rough water areas in order to further enhance blending. For this purpose the process is conducted for more than 90% of its duration at a distance of at least 10 nautic miles from the coast.

The invention is also directed to the blended product and to the above marine vessel comprising the blended product as it arrives at its destination. The invention is also directed to the direct use of the blended product as a fuel, more preferably as an automotive gas oil or as an industrial gas oil.

The invention will be illustrated by means of the following non-limiting examples.

EXAMPLE

A typical mineral derived gas oil (further referred to as AGO) and a typical Fischer-Tropsch gas oil (further referred to as GTL) having the properties as listed in Table 1 were used in the following experiment.

TABLE 1

| Fuel Reference | Units | AGO | GTL |
|---|---|---|---|
| Cetane Index (ASTM D613) | | 51.5 | >74.8 |
| Sulphur | mg/kg | 7 | <5 |
| Vk @ 40° C. | cSt | 2.559 | 3.606 |
| Distillation | | | |
| IBP | ° C. | 167.8 | 211 |
| 50% | ° C. | 263.5 | 298 |
| 90% | ° C. | 325.3 | 339 |
| 95% | ° C. | 341.6 | 349 |
| FBP | ° C. | 351.2 | 354 |
| HPLC Aromatics | | | |
| Total | wt % | 26.9 | 0 |

Two methods of fuel addition were adopted for this assessment, although the essence of both experiments remained the same. These method were the Funnel Technique and the Beaker Technique.

The objective of each technique was to minimise turbulence (and hence mixing) during addition of the second fuel so that the majority of any mixing of the two fuels was due to the length of the contact time. Both techniques involved the preparation of 2×2 liter glass beakers, one containing 800 ml of AGO, the other containing 800 ml of GTL. To the AGO, 800 ml of GTL was added slowly, using a 1 liter glass cylinder, taking approximately 2 minutes to complete (Blend A.) This technique was repeated for the addition of the AGO (800 ml) to GTL (Blend B). To evaluate blend homogeneity, densities of the fuel blends were measured after a period of time at 400 ml and 1200 ml from the bottom of the beaker to assess the density at bottom and top of each blend. The funnel technique for fuel addition involved the pouring of the added fuel over the outer surface of an upside down glass funnel that had its base (funnel mouth) in contact with the inner walls of the glass beaker. This was designed to produce fuel addition over a large surface area, minimise turbulence and hence minimise the mixing of the two fuel layers during addition of the second fuel.

The beaker technique for fuel addition involved the direct pouring of the added fuel down the inner wall of the beaker. This produced fuel addition over a smaller surface area than that of the funnel technique, more turbulence and hence more mixing of the two fuel layers during addition of the second fuel.

Density follows, volume/volume, linear blending rules and a homogeneous 50:50 blend of the AGO and GTL samples studied will have a theoretical density of 813.3 kg/m$^3$. Thus density measurements of the blends can be used to calculate the amount of each component present.

Table 2 depicts the density results and calculated percentage for each component sampled at a depth represented by a volume of 400 ml (bottom), and 1200 ml (top) on the graduated beaker. It should be noted that the density result of 841.8 kg/m$^3$ obtained for Blend A 'Bottom'—funnel method, is greater than 841.4 kg/m$^3$—the density of neat AGO. However, this result does fall within the reproducibility of the IP365 method, and the result indicates that the 'Bottom' sample is 100% AGO. The time that the blends were sub sampled for density analysis were not considered to have to be identical, as the appearance of each blend did not seem to change over the 24-hour period observed.

TABLE 2

| Method type | Blend ref. | Blend configuration | Time at which the blend was checked (minutes) | Density of layer (kg/m$^3$) | Fischer-Tropsch derived % vol. | Mineral gas oil % vol |
|---|---|---|---|---|---|---|
| Funnel method | A | GTL on top | 135 | 788.4 | 94 | 6 |
| | | AGO in bottom | | 841.8 | 0 | 100 |
| Beaker method | | GTL on top | 10 | 797.7 | 78 | 22 |
| | | AGO in bottom | | 824.3 | 30 | 70 |
| Funnel method | B | AGO on top | 145 | 810.9 | 55 | 45 |
| | | GTL in bottom | | 815.8 | 46 | 54 |
| Beaker method | | AGO on top | 7 | 810.0 | 56 | 44 |
| | | GTL in bottom | | 816.5 | 44 | 56 |

When considering respective sets of blends A and B for each method, it is obvious by the percentage of each component present, at both top and bottom, of each blend that to provide optimum blending without agitation then the AGO should be added on top of the GTL and not vice versa.

What is claimed is:

1. A process to blend a mineral derived hydrocarbon product and a Fischer-Tropsch derived hydrocarbon product comprising providing in a storage vessel of a marine vessel a quantity of mineral derived hydrocarbon product and Fischer-Tropsch derived hydrocarbon product such that at loading at least 50 vol % of the Fischer-Tropsch derived product is present in the lower half of the storage vessel, transporting said provided-products in the marine vessel from one location to another destination location thereby blending said provided-products producing blended product, and obtaining the blended product at arrival of the marine vessel at the destination location.

2. The process of claim 1 wherein more than 50% of the boiling ranges of the mineral and the Fischer-Tropsch derived products overlap.

3. The process of claim 1 wherein the mineral hydrocarbon product is a crude mineral oil, a gas field condensate, a plant condensate or naphtha, kerosene, gas oil, vacuum distillate, deasphalted oil or a residual fraction of crude oils.

4. The process of claim 3 wherein the blended product is a blend of a mineral crude oil and Fischer-Tropsch syncrude, a blend of Fischer-Tropsch derived naphtha and gas field condensate, a blend of Fischer-Tropsch derived gas oil and mineral derived gas oil or the blend of a Fisher-Tropsch derived waxy raffinate and mineral oil derived vacuum distillates and/or mineral oil derived deasphalted oil.

5. The process of claim 4 wherein a blend of Fischer-Tropsch derived gas oil and mineral derived gas oil is prepared.

6. The process of claim 5 further comprising adding additives to the blend while off-loading the blended product from the marine vessel at the destination location.

7. The process of claim 1 wherein the transport takes place for at least 10 days.

8. A marine vessel comprising a storage vessel in which is being conducted by the process of claim 1.

9. The process of claim 1 comprising a subsequent step of directly using the blended product as an automotive gas oil or as an industrial gas oil.

10. The process of claim 1 wherein at loading at least 70 vol % of the Fischer-Tropsch derived product present in the lower half of the storage vessel.

11. The process of claim 10 wherein at loading at least 90 vol % of the Fischer-Tropsch derived product present in the lower half of the storage vessel.

12. The process of claim 1 wherein the blended product at the destination location, the difference in density between a sample taken at 10% of the liquid height below the liquid surface, d1, and the density of a sample taken at 90% of the liquid height below the liquid surface, d9, such that the ratio d90-d10/d10 is less than 0.01.

* * * * *